US005222316A

United States Patent [19]

Chiou

[11] Patent Number: 5,222,316

[45] Date of Patent: Jun. 29, 1993

[54] ELECTRICAL READING GUIDE DEVICE FOR USE IN TYPING BY A TYPIST

[76] Inventor: Shih-Kuen Chiou, No. 584, Sec. 2, Chung-San Rd., Hwu-Lian Village, Yeong-Jing Shiang, Changhua Shiann, Taiwan

[21] Appl. No.: 933,131

[22] Filed: Aug. 20, 1992

Related U.S. Application Data

[63] Continuation-in-part of Ser. No. 718,703, Jun. 21, 1991, abandoned.

[51] Int. Cl.[5] ..... B41J 11/64

[52] U.S. Cl. ..... 40/352

[58] Field of Search ..... 400/718; 40/352, 353, 40/356; 74/89.2, 89.14, 89.21, 89.22

[56] References Cited

U.S. PATENT DOCUMENTS

| | | | |
|---|---|---|---|
| 595,140 | 12/1897 | Brooks | 40/356 |
| 982,500 | 1/1911 | Iliffe | 74/89.14 |
| 1,042,628 | 10/1912 | Waybright | 74/89.2 |
| 1,723,332 | 8/1929 | Day et al. | 40/353 X |
| 2,739,569 | 3/1956 | Brazee | 40/353 X |
| 2,765,543 | 10/1956 | Crowell et al. | 40/353 X |
| 3,044,312 | 7/1962 | Hall et al. | 74/89.22 |
| 3,231,260 | 1/1966 | Shirley | 74/89.22 X |
| 4,534,233 | 8/1985 | Hamaguchi | 74/89.14 X |
| 5,088,217 | 2/1992 | Canaday | 40/356 |

*Primary Examiner*—Kenneth J. Dorner
*Assistant Examiner*—J. Bonifanti
*Attorney, Agent, or Firm*—Browdy and Neimark

[57] ABSTRACT

An electrical reading guide device for use in typing by a typist is composed mainly of a reading guide plate and a driving apparatus capable of making an up-and-down movement along a strip furrow located at the margin of one side of the reading guide plate. The driving apparatus comprises a transmission device and a pulling device. The transmission device comprises a reversible motor having a shaft with a worm rod attached thereto and a driven gear set having a winding cylinder attached thereto. The pulling device comprises a wire wound around the winding cylinder. When the reversible motor is activated, the worm rod triggers the driven gear set to rotate so as to drive one winding cylinder to wind the wire while another winding cylinder is in a state of unwinding the wire. Therefore, the driving apparatus is capable of moving in a direction in which the wire is wound by the winding cylinder.

4 Claims, 3 Drawing Sheets

ELECTRICAL READING GUIDE DEVICE FOR USE IN TYPING BY A TYPIST

The present application is a continuation-in-part of application Ser. No. 07/718,703, filed Jun. 21, 1991, which is hereby incorporated by reference in the entirety now abandoned.

BACKGROUND OF THE INVENTION

The present invention relates to an office equipment, and more particularly to an electrical reading guide device for use in typing by a typist.

The electrical reading guide device of prior art for use in typing by a typist is composed mainly of a reading guide plate and a vertical positioning device which in turn comprises a main body and a fastening plate. The main body comprises therein a reversible motor serving to actuate a gear set. The gear set and the gear strip located on the back of the guide groove of the plate body coordinate to form a basic rail for positioning. A guide rule, which is used to point out the way for a typist to read the manuscript which she or he is typing, is connected with the fastening plate of the positioning device and is therefore capable of making a synchronous up-and-down movement along with the positioning device.

The electrical reading guide device of prior art described above has two major inherent defects, which are explicitly expounded hereinafter.

The up-and-down movement of the positioning device of prior art is made possible by means of a simultaneous engagement of the gear strips of the guide groove actuated by two gear sets. The contact area between the gear set and the gear strips is so substantially large that their frictional engagement always brings about a loud and uncomfortable noise.

The components of the electrical reading guide device of prior art are expensive and difficult to come by because they are manufactured in accordance with certain sets of specifications. In addition, the task of assembling components of device is tedious.

SUMMARY OF THE INVENTION

It is, therefore, the primary objective of the present invention to provide a quiet electrical reading guide device for use in typing by a typist.

It is another objective of the present invention to provide an affordable electrical reading guide for use in typing by a typist.

In keeping with the principles of the present invention, the primary objectives of the present invention are accomplished by an electrical reading guide device for use in typing, which comprises mainly a reading guide plate and a driving apparatus. The driving apparatus is arranged in such a manner that it is capable of making an up-and-down movement along the strip furrow located at the margin of one side of the reading guide plate. The driving apparatus is characterized in that it is composed of a transmission means and a pulling means. The transmission means comprises a reversible motor having a shaft with a worm attached thereto and a driven gear set having a winding cylinder attached to one side thereof. The pulling means comprises at least one independent string of appropriate length, which are wound around with an appropriate tightness the winding cylinder. As soon as the reversible motor is activated, the worm which is attached to the shaft of the activated motor triggers the driven gear set to rotate, which in turn drives the winding cylinder to turn. The driving apparatus is therefore capable of moving in a direction in which the string is being wound by the winding cylinder.

DETAILED DESCRIPTION OF THE PREFERRED EMBODIMENTS

Figure 1:
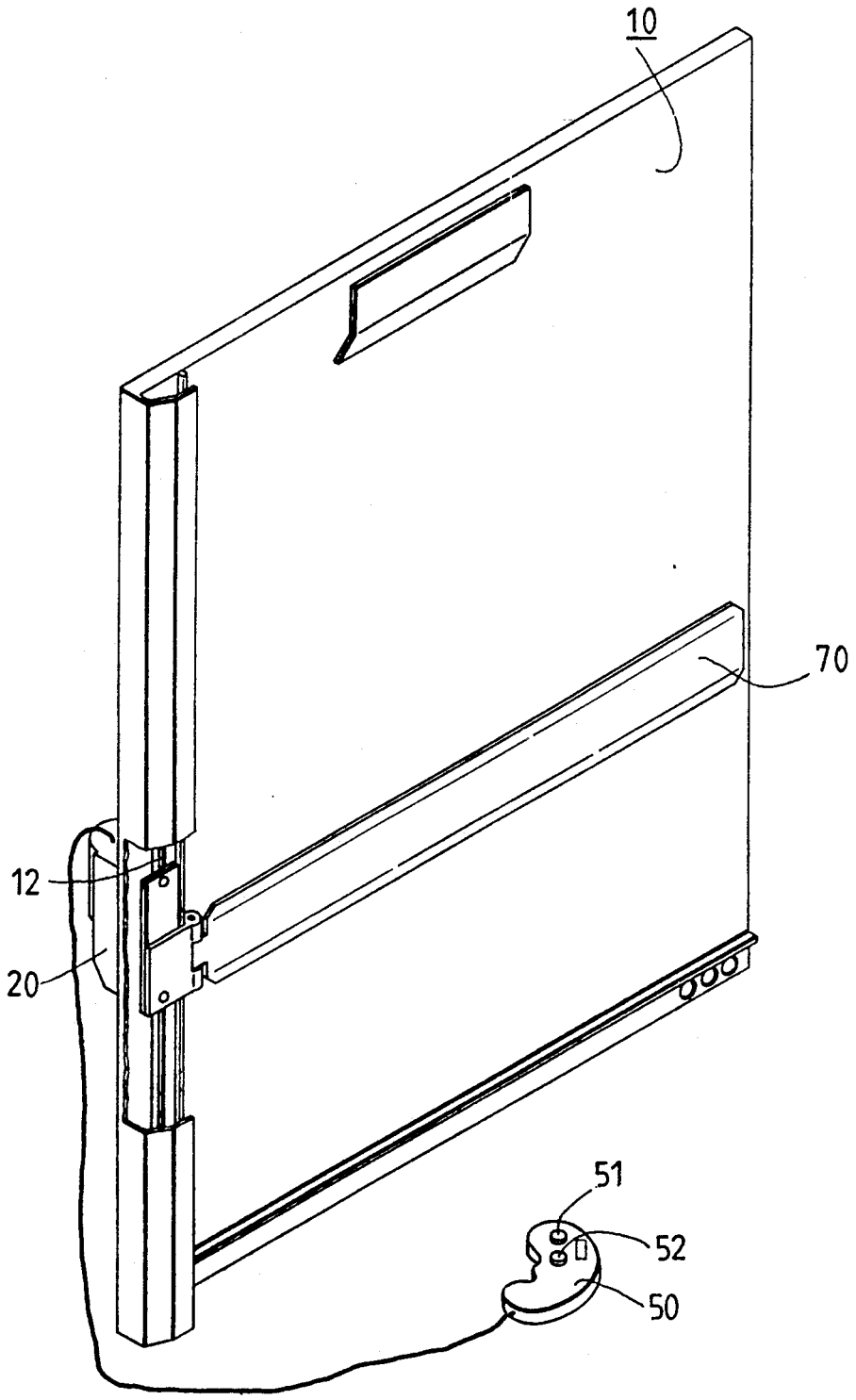
FIG. 1 shows a three-dimensional view of a first preferred embodiment of the present invention.
Figure 3:
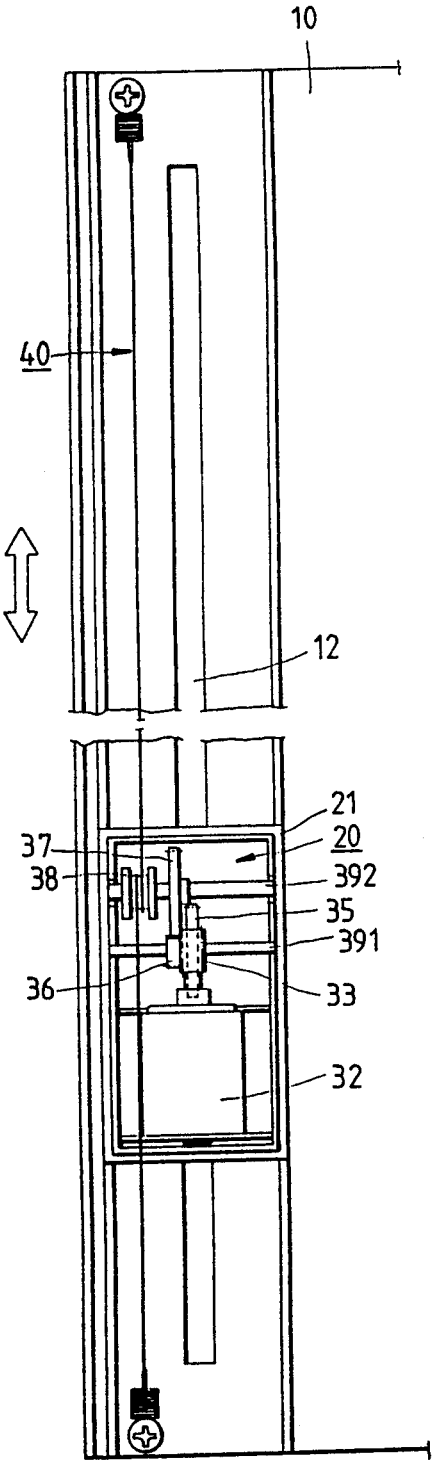
FIG. 3 shows a top plan view of the present invention as shown in FIG. 2.
Figure 2:
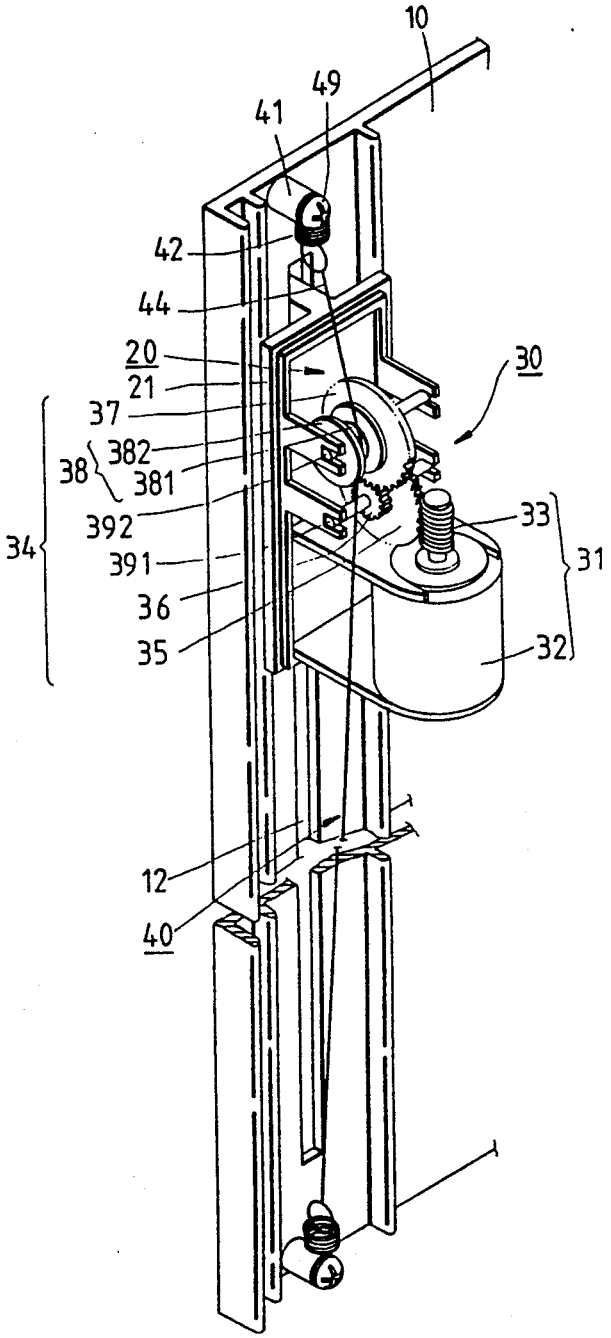
FIG. 2 shows a three-dimensional view of the driving apparatus of the present invention, with the housing of the driving apparatus being omitted in the drawing.

Referring to FIGS. 1–3, an electrical reading guide device for use in typing embodied in the present invention is shown comprising a reading guide plate 10 and a driving apparatus 20.

The reading guide plate 10 is provided with an upright strip furrow 12 located at the front margin thereof. The driving apparatus 20 has a bearing seat 21 upon which a transmission apparatus 30 and a pulling apparatus 40 are mounted. The bearing seat 21 is mounted on the strip furrow 12 in such a manner that it can make an up-and-down movement.

The transmission apparatus 30 comprises a driving member 31 and a driven member 34.

The driving member 31 has a reversible motor 32 and a worm rod 33 mounted on a shaft of the reversible motor 32.

The driven member 34 comprises first gear sets 35 and 36, a second gear 37, and a winding cylinder 38 adjacent to the second gear 37. By means of a shaft 391, the first gear sets 35 and 36 are mounted across the bearing seat 21 in such a manner that its large gear 35 engages the worm rod 33. By means of a shaft 392, the second gear 37 is mounted in front of the first gear sets 35 and 36 in such a way that it meshes with a pinion 36. The winding cylinder 38 has a shaft cylinder 381 of a predetermined width and rings 382 located at both ends thereof. The winding cylinder 38 is securely arranged on the shaft 392 and is capable of turning synchronously with the second gear 37.

The pulling apparatus 40 comprises two threaded columns 41, two coil springs 42 and a steel wire 44. The two threaded columns 41 are respectively disposed at top and bottom ends of the upright strip furrow 12. Each of the two coil springs 42 has one end that is fastened securely to the threaded column 41 by means of a screw 49. The steel wire 44 is wound around the winding cylinder 38, with both free ends thereof being fastened to the ends of the two coil springs 42.

When the upper touch-set switch 51 of the remote controller 50 of the present invention is pressed by a typist, the reversible motor 32 begins turning rapidly in a counter-clock-wise direction so as to actuate the worm rod 33 to rotate synchronously, which in turn triggers the large gear 35 to rotate in a clockwise direction. Subsequently, the pinion 36 actuates the second gear 37 to turn in a counter-clock-wise direction so as to initiate the synchronous rotation of the winding cylinder 38. As a result, the driving apparatus 20 is capable of moving upward along the strip furrow 12 in conjunction with a guide rule 60. On the other hand, when the lower touch-set switch 52 is pressed, the driving apparatus 20 moves downward along the strip furrow 12.

Figure 4:
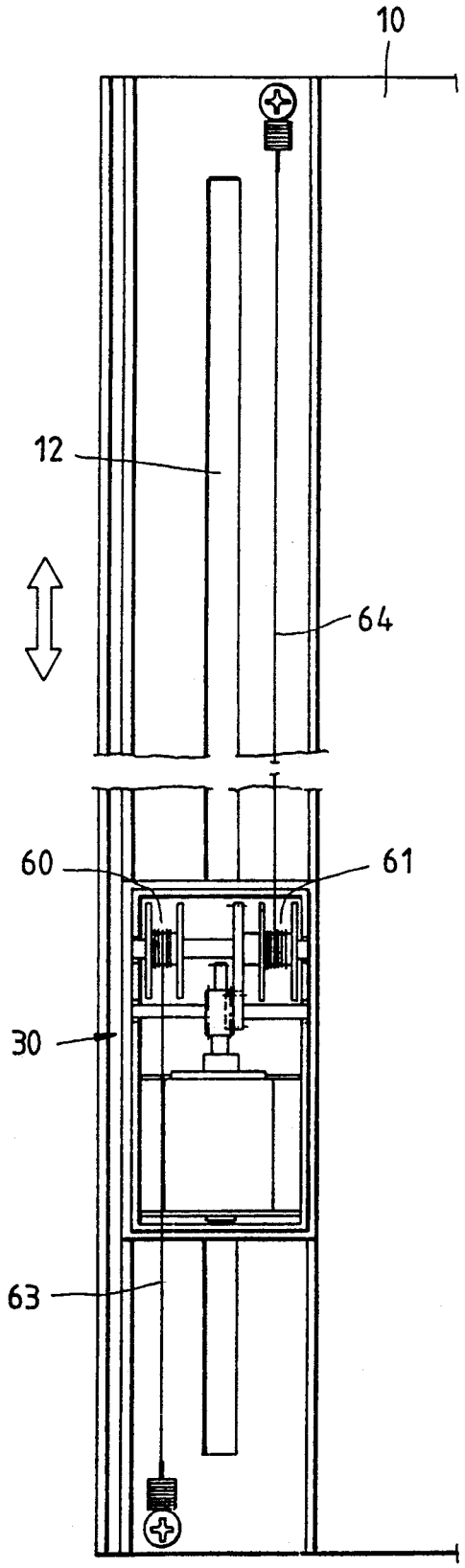
FIG. 4 shows a top view of a second preferred embodiment of the present invention.

As shown in FIG. 4, the second preferred embodiment of the present invention is different from the first preferred embodiment described above in that the former is provided with the two winding cylinders 60 and 61 opposite to each other. There are two wires 63 and 64 which wind respectively around the two winding cylinders 60 and 61. At the time when the winding cylinder 61 is in a state of winding the wire 64, the winding cylinder 60 is unwinding the wire 63, so as to cause the driving apparatus 20 to move upward along the strip furrow 12 in conjunction with the winding direction of the winding cylinder 61. Under the circumstance contrary to what has been described above, the driving apparatus 20 moves downward along the strip furrow 12.

The embodiment of the present invention described above is to be considered in all respects as merely an illustration of principles of the present invention. Accordingly, the present invention is to be limited only by the scope of the hereinafter appended claims.

What is claimed is:

1. An electrical reading guide device for use in typing by a typist, said device comprising:

a reading guide plate having an upright strip furrow disposed at margin of one side thereof, a driving apparatus arranged moveably along said strip furrow and having a guide rule attached thereto, said driving apparatus having a transmission apparatus, said transmission apparatus having a driving transmission set including a reversible motor having a shaft with a worm rod attached thereto and at least a driven gear set having shafts, a pulling apparatus having at least one wire of a length, said at least one wire engaged around winding cylinder means for winding said at least one wire, said winding cylinder means coupled to said driven gear set to cause said winding cylinder means to turn and wind or unwind said at least one wire so as to drive said driving apparatus to move upward or downward along said strip furrow.

2. The electrical reading guide device for use in typing by a typist according to claim 1 wherein said driven gear set comprises a first gear set and a second gear, said winding cylinder means being adjacent to said second gear, said first gear set comprising a large gear and a pinion which are mounted on a bearing seat by a first shaft in such a manner that said large gear meshes with said worm rod, said second gear being disposed above said first gear set by a second shaft and engaging said pinion;

wherein said winding cylinder means is arranged at one end of said second shaft and is provided with a shaft cylinder having rings located at both ends thereof.

3. The electrical reading guide device for use in typing by a typist according to claim 1, wherein said at least one wire of said pulling apparatus has two free ends, one of which is fastened to one end of a coil spring having another end that is secured to a threaded column located at a bottom end of said strip furrow.

4. The electrical reading guide device for use in typing by a typist according to claim 1 wherein said pulling apparatus has two wires, and said winding cylinder means has two winding cylinders, each of said two winding cylinders has a shaft cylinder having rings located at both ends thereof, wherein one end of each of said two wires is fastened to a threaded column and a second end of each of said two wires is respectively wound around said each of said two winding cylinders.

* * * * *